US010781973B2

(12) United States Patent
Bernard et al.

(10) Patent No.: US 10,781,973 B2
(45) Date of Patent: Sep. 22, 2020

(54) PRESSURE VESSELS

(71) Applicant: Crompton Technology Group Limited, West Midlands (GB)

(72) Inventors: James Bernard, Brackley (GB); Jon Pethick, Leicestershire (GB); Ian Chase, Charfield (GB)

(73) Assignee: CROMPTON TECHNOLOGY GROUP LIMITED, Solihull, West Midlands (GB)

( * ) Notice: Subject to any disclaimer, the term of this patent is extended or adjusted under 35 U.S.C. 154(b) by 184 days.

(21) Appl. No.: 15/935,436

(22) Filed: Mar. 26, 2018

(65) Prior Publication Data

US 2018/0283611 A1 Oct. 4, 2018

(30) Foreign Application Priority Data

Mar. 31, 2017 (EP) ..... 17164436

(51) Int. Cl.
*F17C 1/16* (2006.01)
*F17C 13/08* (2006.01)
*F17C 1/06* (2006.01)

(52) U.S. Cl.
CPC ..... *F17C 1/16* (2013.01); *F17C 1/06* (2013.01); *F17C 13/08* (2013.01); *F17C 2201/0119* (2013.01); *F17C 2201/0152* (2013.01); *F17C 2201/0166* (2013.01); *F17C 2201/0171* (2013.01); *F17C 2201/035* (2013.01); *F17C 2201/056* (2013.01); *F17C 2203/012* (2013.01);

(Continued)

(58) Field of Classification Search
CPC ..... F17C 1/04; F17C 1/06; F17C 1/08
See application file for complete search history.

(56) References Cited

U.S. PATENT DOCUMENTS 2,370,677 A * 3/1945 Mapes ..... F17C 1/06 220/590
6,883,536 B2 4/2005 Hervio et al.
(Continued)

FOREIGN PATENT DOCUMENTS

WO 2016057023 A1 4/2016

OTHER PUBLICATIONS

Extended European Search Report for International Application No. 17164436.2 filed Nov. 13, 2017, 7 pages.

*Primary Examiner* — Jeffrey R Allen
(74) *Attorney, Agent, or Firm* — Cantor Colburn LLP

(57) ABSTRACT

A pressure vessel includes front and rear end plates and a plurality of open-ended vessel structures constructed of fibre-reinforced polymer matrix composite material positioned adjacent to one another so that their longitudinal axes are parallel to a longitudinal direction extending between the front and rear end plates. The vessel also includes an outer reinforcement comprising polymer matrix composite material with continuous fibres extending longitudinally around the pressure vessel to secure the front and rear end plates to the vessel structures. At least one of the vessel structures has a partially curved cross section in a plane perpendicular to its longitudinal axis, such that one or more crevices are formed between the vessel structures, running longitudinally between the front and rear end plates and the front and rear end plates are shaped to allow the outer reinforcement to at least partially fill the one or more crevices between the vessel structures.

15 Claims, 4 Drawing Sheets

(52) U.S. Cl.
CPC *F17C 2203/066* (2013.01); *F17C 2203/0619* (2013.01); *F17C 2203/0621* (2013.01); *F17C 2203/0663* (2013.01); *F17C 2203/0665* (2013.01); *F17C 2203/0668* (2013.01); *F17C 2205/0142* (2013.01); *F17C 2205/0146* (2013.01); *F17C 2209/2163* (2013.01); *F17C 2209/22* (2013.01); *F17C 2209/234* (2013.01); *F17C 2221/011* (2013.01); *F17C 2260/011* (2013.01); *F17C 2260/012* (2013.01); *F17C 2270/0189* (2013.01)

(56) References Cited

U.S. PATENT DOCUMENTS

| | | | |
|---|---|---|---|
| 7,971,740 | B2 | 7/2011 | Shimada et al. |
| 8,794,478 | B2 | 8/2014 | Strassburger et al. |
| 9,440,529 | B2 | 9/2016 | Lee |
| 2004/0211784 | A1 | 10/2004 | Luongo |
| 2010/0133279 | A1 | 6/2010 | Berry et al. |

* cited by examiner

PRESSURE VESSELS

FOREIGN PRIORITY

This application claims priority to European Patent Application No. 17164436.2 filed Mar. 31, 2017, the entire contents of which is incorporated herein by reference.

TECHNICAL FIELD

The present disclosure relates to pressure vessels, in particular pressure vessels made of a polymer matrix composite material. This disclosure is concerned with space and weight saving features of such pressure vessels.

BACKGROUND

High pressure gas cylinders are commonly used on aircraft as a form of energy storage in many interior systems, including escape chute inflation systems, oxygen cylinders and pressure containers for door opening systems. The high pressure cylinders in these systems can be made from various materials including one or more of: steel, aluminium, titanium and fibre-reinforced polymer matrix composite materials using Kevlar, glass and/or carbon fibre reinforcement, e.g. carbon fibre reinforced polymer (CFRP). A composite overwrapped pressure vessel (COPV) is a vessel consisting of a thin, non-structural liner (e.g. of aluminium) wrapped with a structural fibre-reinforced composite material. The liner provides a barrier between the pressurised fluid and the composite material, preventing leaks (which can occur through matrix microcracks) and chemical degradation of the structure.

The use of fibre-reinforced polymer matrix composite materials typically offers a weight saving over metallic pressure vessels e.g. gas cylinders of a similar size. This is desirable due to the consequent increase in fuel efficiency for the aircraft.

High pressure gas cylinders are also used in automobiles to store natural gas, and the weight savings produced by using fibre-reinforced polymer matrix composite materials, rather than heavier materials, can both increase fuel efficiency and improve the performance (e.g. acceleration) of the automobile.

The most weight efficient shape for a pressure vessel such as a compressed gas cylinder is actually a sphere, however it is far more common for pressure vessels to be cylindrical in shape due to packaging constraints. Spatial efficiency can be improved by arranging a series of cylinders in an amalgamated pressure vessel layout. U.S. Pat. No. 7,971,740 provides an example of a pressure vessel assembly that integrates a plurality of vessel structures, each including a cylindrical liner open at both ends and a fibre-reinforced resin layer around the peripheral walls of the liner. The liners are integrated with external flanges that enable adjacent vessel structures to be joined to each other. Dome-shaped end members made of aluminium or resin are joined to the flanges and enable fluid communication between the vessel structures. For a higher pressure resistance, a secondary fibre-reinforced resin layer is formed across all of the vessel structures by winding resin-impregnated reinforcing e.g. glass or carbon fibres (or bundles of fibres) circumferentially, axially and/or helically around the arrangement of vessel structures, using a filament winding method.

An advantage of forming CFRP vessel structures as open-ended tubes, rather than traditional cylinders with domed ends, is that a separate liner is not required for winding on to and the tubes can be filament wound on a parallel mandrel with easy extraction of the mandrel. Following extraction, the tubes can be efficiently cut to any desired length before being joined together in a pressure vessel assembly using end members or manifolds. The pressure vessel assembly seen in U.S. Pat. No. 7,971,740 relies on the liners of the vessel structures to provide the flanges that allow the structures to be joined together and bonded to the dome-shaped end members, for example using a friction agitation joining method. There remains a need for improved ways of forming such a pressure vessel assembly, in particular reducing one or more of: the part count, weight and/or cost.

SUMMARY

According to the present disclosure there is provided a pressure vessel comprising: front and rear end plates; a plurality of open-ended vessel structures, constructed of fibre-reinforced polymer matrix composite material, the open-ended vessel structures positioned adjacent to one another so that their longitudinal axes are parallel to a longitudinal direction extending between the front and rear end plates, and the open-ended vessel structures being closed by the front and rear end plates; and an outer reinforcement comprising polymer matrix composite material with continuous fibres extending longitudinally around the pressure vessel to secure the front and rear end plates to the vessel structures; wherein at least one of the vessel structures has a partially curved cross section in a plane perpendicular to its longitudinal axis, such that one or more crevices are formed between the vessel structures, running longitudinally between the front and rear end plates; and wherein the front and rear end plates are shaped to allow the outer reinforcement to at least partially fill the one or more crevices between the vessel structures.

By using an outer reinforcement comprising continuous longitudinal fibres to secure the front and rear end plates to the vessel structures, no structural connection, bond or otherwise, is required between the end plates and the vessel structures. Manufacturing of the pressure vessel may therefore be simplified. Furthermore, no axial load is transmitted along the length of the vessel structures as this can now be carried by the longitudinal fibre in the outer reinforcement instead. As will be discussed further below, this enables the vessel structures to be optimised for hoop stress alone.

The outer reinforcement may be formed in any suitable way that results in continuous fibres extending longitudinally around the pressure vessel. In other words, the fibres in the outer reinforcement wrap around the outside of the pressure vessel and extend longitudinally between the front and rear end plates.

This means that the longitudinal fibres can transmit axial loads between the end plates without the vessel structures bearing any axial loads. The polymer matrix composite material of the outer reinforcement may comprise or consist of carbon fibre reinforced polymer (CFRP). The outer reinforcement may be formed by winding resin-impregnated reinforcing fibres or tapes (e.g. so-called "prepregs") around the end plates, e.g. using a filament winding technique, and then curing the resin.

In some examples the outer reinforcement may comprise one or more reinforcing bands of polymer matrix composite material, for example a plurality of spaced bands. Such reinforcing bands may have a lateral width that is much less than the lateral width of the pressure vessel. Such reinforcing bands may have a lateral width that matches the crevices running longitudinally between the vessel structures.

In some examples the outer reinforcement may comprise a layer of polymer matrix composite material. Such a layer may have a lateral width that substantially matches the lateral width of the pressure vessel. Such a layer may fill the crevices running longitudinally between the vessel structures and extend laterally between adjacent crevices.

It will be appreciated that the outer reinforcement at least partially filling the one or more crevices between the vessel structures provides a benefit over filling the crevices with non-structural material adding to the overall weight. Furthermore, the crevices conveniently provide longitudinal cavities for the axial reinforcement fibres, meaning that winding of the outer reinforcement is simple to control and therefore automate. Preferably the outer reinforcement completely fills the one or more crevices between the vessel structures. The outer reinforcement may therefore provide a flat, rather than undulating, outer surface for the pressure vessel. This may facilitate the option of applying additional reinforcement, for example a further outer reinforcement of "hoop" fibres as is disclosed below.

As is discussed above, an advantage of the outer reinforcement providing continuous longitudinal fibres to secure the front and rear end plates to the vessel structures is that a purely mechanical connection is provided. This may assist with aerospace certification. Chemical joining techniques, such as welding, adhesive bonding and friction agitation joining, are not required. Preferably there is no adhesive bond between the vessel structures and the end plates.

In addition to the open-ended vessel structures being closed by the front and rear end plates, the pressure vessel may include seals arranged between the open ends of the vessel structures and the end plates, for example one or more elastomer seals disposed between the end plates and each of the vessel structures. Preferably such seals are arranged to prevent fluid leakage even under high internal pressure. In a set of examples, the end plates may comprise a plurality of flanges, each flange extending inwards along the longitudinal direction to engage with one of the open-ended vessel structures and carry a seal. The seal may be arranged in a groove on the flange. The seal may be arranged on an outer or inner surface of the flange. The flanges may be shaped to match the open-ended vessel structures. For example, each flange may have a cross section, in a plane perpendicular to the longitudinal axis of a corresponding vessel structure, which substantially matches its corresponding vessel structure. Each of the end plates may comprise a plurality of flanges having one or more different shapes in cross section, for example to match a non-uniform plurality of vessel structures. The cross-sectional shape of the vessel structures is discussed further below.

In at least some examples the front and rear end plates may also be constructed of fibre-reinforced polymer matrix composite material. However, in order to provide the necessary hoop strength, such end plates would likely need to be outwardly domed and therefore take up more space. It is preferable that the front and rear end plates are made of metal.

In addition, or alternatively, the applicant has recognised that the end plates may be optimised for space efficiency and weight saving. In a preferred set of examples the end plates do not substantially extend laterally beyond the outer diameter of the vessel structures. In addition, or alternatively, in a preferred set of examples the end plates are substantially planar, for example in a plane perpendicular to the longitudinal axes of the vessel structures. This can minimise the weight of material contributed by the end plates, which is especially helpful for metal end plates. However a planar end plate would normally include corners between its planar sides and this can pose problems for the overwrap of outer reinforcement.

In addition, or alternatively, the applicant has recognised that the end plates may be designed to avoid cutting or damaging the continuous fibres which extend longitudinally around the pressure vessel to secure the front and rear end plates to the vessel structures. A straight or curved wrap path for the longitudinal fibres is desirable. Thus, in a preferred set of examples, at least a portion of the front and rear end plates in contact with the outer reinforcement has a cross sectional profile, in a plane parallel to the longitudinal axes of the vessel structures, that contains no corners, such that the longitudinal fibres do not come into contact with sharp and potentially damaging edges. In other words, at least a portion of the front and rear end plates in contact with the outer reinforcement has a cross sectional profile, in a plane parallel to the longitudinal axes of the vessel structures, that is substantially curved or contains several linear portions of gradually increasing angle.

As is described above, a function of the front and rear end plates is to close the plurality of open-ended vessel structures and provide a structural connection between them. It will be appreciated that the vessel structures do not need to be bonded to one another. Nor do the vessel structures even need to touch one another, although it may be preferable for the vessel structures to be arranged in a space-saving array which limits the volume of wasted space in between the vessel structures. Another possible function of the front and rear end plates is to provide a fluid connection between the plurality of open-ended vessel structures. In a preferred set of examples at least one of the front and rear end plates comprises a fluid flow path between at least one of the vessel structures and another one or more of the vessel structures. The at least one end plate may comprise an internal chamber connected to each of the plurality of open-ended vessel structures. The at least one end plate may therefore take the form of a manifold. Furthermore, at least one end plate may optionally comprise a valve allowing for the inlet and/or outlet of fluid to the plurality of open-ended vessel structures. This is beneficial as it means that the walls of the composite vessel structures themselves do not need to be interrupted by a valve.

The vessel structures may have any suitable shape comprising a partially curved cross section in a plane perpendicular to its longitudinal axis. The vessel structures may not all have the same shape. Preferably each vessel structure is a generally longitudinal structure with an aspect ratio much greater than one, wherein the aspect ratio is the length of the structure along its longitudinal axis divided by the width or diameter of the structure in a plane perpendicular to its longitudinal axis. The vessel structures may be generally cylindrical in shape, for example taking the form of open-ended tubes. At least some of the vessel structures may have a generally circular or oval cross-section in a plane perpendicular to their longitudinal axes. However, the applicant has realised that it may be beneficial to avoid an entirely circular geometry in order to maximise packing efficiency for the vessel structures making up the pressure vessel.

In a preferred set of examples, at least some of the vessel structures comprise at least one flat wall in a plane perpendicular to their longitudinal axes. At least some of the vessel structures are preferably oriented so as to have a flat wall in contact with another flat wall of an adjacent vessel structure. This means that the vessel structures can be packed more closely together. Of course each vessel structure needs to be able to withstand the internal pressure of a fluid inside the pressure vessel. The applicant has realised that the wall thickness of each vessel structure may be reduced when it has a flat wall in contact with the flat wall of an adjacent vessel structure, as the effective wall thickness is doubled. Additionally, the net pressure on the flat walls that are in contact with each other in this example is equal to the difference between the pressures in the adjacent vessel structures. This difference may be less than the difference between the pressure inside either of the adjacent vessels and the external pressure, in which case the net radial force on the flat walls is lower than the radial force on the external walls. As a result, the overall hoop stresses within the walls of each vessel structure are reduced and hence the wall thickness may be reduced.

In examples where the pressures inside the two vessel structures are substantially equal, for instance in examples comprising a fluid flow path between the vessel structures, the net radial force on the flat walls is reduced to substantially zero. While radial forces still act on the curved walls, as a result the overall hoop stresses in the vessel structures are reduced and their wall thicknesses may be minimised, resulting in lower weight. This may conveniently be achieved by at least one of the end plates providing such a fluid flow path, as mentioned above.

In some examples, at least some of the vessel structures comprise a lozenge shape in a plane perpendicular to their longitudinal axes, the lozenge shape comprising first and second parallel flat walls and curved walls connecting the first and second parallel flat walls. Preferably these vessel structures are arranged side-by-side in contact with one another in the pressure vessel such that the curved walls form the crevices between the vessel structures which run longitudinally between the front and rear end plates.

It is mentioned above that a lozenge shape may be preferred for the vessel structures as it means they can be packed more efficiently side-by-side with a reduced thickness for the flat walls. Vessel structures constructed of fibre-reinforced polymer matrix composite material, e.g. CFRP, are typically made using a filament winding process. A lozenge shape may be provided by a suitably shaped mandrel around which the fibre reinforcement is wrapped. However, this means that all the (flat and curved) walls of the vessel structure usually have the same wall thickness. The external curved walls are not in contact with any adjacent walls and must therefore have a wall thickness designed to withstand the expected internal pressure. The flat walls can only be made thinner than the curved walls by implementing additional manufacturing steps e.g. to thicken the curved walls. This makes it difficult to take advantage of the double wall thickness provided by the internal flat walls. The applicant has realised that the wall thickness of the curved walls can be reduced by adding a further outer reinforcement comprising polymer matrix composite material with continuous fibres extending circumferentially around the pressure vessel. This further outer reinforcement may wrap over the external curved walls of the vessel structures that have a lozenge shape. This means that the wall thickness of the individual vessel structures can then be set by the requirements of the internal flat walls, thereby improving weight efficiency.

Such a further outer reinforcement can advantageously increase the overall "hoop" strength of the pressure vessel regardless of the cross-sectional shape of the vessel structures. Thus in various examples the pressure vessel may comprise a further outer reinforcement comprising polymer matrix composite material with continuous fibres extending circumferentially around the pressure vessel. The fibres in this further outer reinforcement may be high angle "hoop" fibres, e.g. extending at an angle of at least 80° relative to the longitudinal axes of the vessel structures. Preferably the fibres in the further outer reinforcement are oriented substantially perpendicular, i.e approaching 90°, to the longitudinal axes of the vessel structures. Preferably the "hoop" fibres in the further outer reinforcement extend around the entire pressure vessel. It will be appreciated that these "hoop" fibres may be prevented from sagging into the crevices between the vessel structures because the longitudinal fibres of the underlying outer reinforcement at least partially fill, and preferably completely fill, the crevices between the vessel structures.

In some examples the "hoop" fibres providing the further reinforcement may not take the form of an outer reinforcement and may instead be wrapped circumferentially around the pressure vessel before the outer reinforcement of longitudinal fibres is applied to secure the front and rear end plates to the vessel structure. In such examples the pressure vessel may comprise an inner reinforcement comprising polymer matrix composite material with continuous fibres extending circumferentially around the pressure vessel. Such an inner reinforcement may be applied using automated fibre placement (AFP) rather than filament winding. It will be appreciated that these "hoop" fibres may follow the contours of the crevices, resulting in an undulating surface with crevices that follow the underlying crevices between the vessel structures. When the outer reinforcement of longitudinal fibres is formed over the inner reinforcement, the longitudinal fibres fill these crevices in the same way as previously described.

The polymer matrix composite material of the further outer reinforcement may comprise or consist of carbon fibre reinforced polymer (CFRP). The further outer reinforcement may be formed by winding resin-impregnated reinforcing fibres or tapes (e.g. so-called "prepregs") around the vessel structures, e.g. using a filament winding technique, and then curing the resin. Preferably the further outer reinforcement is provided between the front and rear plates and preferably does not wrap over the end plates.

In some examples the further outer reinforcement may comprise one or more reinforcing bands of polymer matrix composite material. In some examples the outer reinforcement may comprise a continuous layer of polymer matrix composite material.

According to the present disclosure the open-ended vessel structures are constructed of fibre-reinforced polymer matrix composite material. The vessel structures may comprise such composite material in combination with another material, for example a composite material vessel structure with an inner liner of metal. However it is preferable that the vessel structures solely consist of fibre-reinforced polymer matrix composite material. In other words, the vessel structures are preferably unlined. This can optimise the strength to weight ratio of the pressure vessel. In any of these examples, the vessel structures may be made of any suitable polymer matrix composite material. The polymer matrix composite material is preferably a fibre-reinforced polymer matrix composite material, e.g. comprising glass or carbon fibres. In many examples the polymer matrix composite material is carbon fibre reinforced polymer (CFRP). Such materials are inherently corrosion resistant and provide a large weight saving and improved fatigue performance.

The open-ended vessel structures may be made using any suitable manufacturing technique. A fibre-reinforced polymer matrix composite material may be formed by braiding, automated fibre placement (AFP) or prepreg wrap techniques. However in preferred examples the vessel structures are filament wound structures. Filament winding techniques are particularly well-suited for making vessel structures from carbon-fibre reinforced polymer (CFRP).

A filament wound composite vessel structure may be formed so as to optimise its hoop strength. In a typical filament winding process for a pressure vessel, carbon fibres are wound around a mandrel circumferentially at an angle higher than 80°, for example angles close to 90°. Accordingly each of the vessel structures is preferably constructed of fibre-reinforced polymer in which the fibres are oriented substantially perpendicular to the longitudinal axes of the vessel structures. This means that the vessel structures are structurally optimised for the expected internal pressure of the overall vessel.

According to the present disclosure there is further provided a method of manufacturing a pressure vessel, the method comprising: positioning a plurality of open-ended vessel structures constructed of fibre-reinforced polymer matrix composite material to be adjacent to one another so that their longitudinal axes are parallel; closing the open-ended vessel structures with front and rear end plates; wherein at least one of the vessel structures has a partially curved cross section in a plane perpendicular to its longitudinal axis such that one or more crevices are formed between the vessel structures, running longitudinally between the front and rear end plates; and applying an outer reinforcement comprising polymer matrix composite material by winding continuous fibres to extend longitudinally around the pressure vessel to secure the front and rear end plates to the vessel structures, wherein the front and rear end plates are shaped to allow the outer reinforcement to at least partially fill the one or more crevices between the vessel structures.

It will be appreciated that the step of applying the outer reinforcement will typically comprise heating/curing the polymer matrix composite material. Accordingly the outer reinforcement can act to hold all the components of the pressure vessel together and form a mechanical connection between the vessel structures and the end plates, e.g. without any adhesive bonding. The outer reinforcement can act as an axial load bearing component for the pressure vessel, so that the vessel structures need only bear the hoop stress arising from the contained volume of fluid. In order to improve the hoop strength of the pressure vessel, the method may further comprise: applying a further outer reinforcement comprising polymer matrix composite material by winding continuous fibres to extend circumferentially around the pressure vessel. This further outer ("hoop") reinforcement may be applied before curing the outer ("axial") reinforcement of longitudinal fibres, or afterwards e.g. in a subsequent manufacturing step.

Method steps according to the present disclosure may be carried out using any suitable manufacturing technique. A fibre-reinforced polymer matrix composite material may be formed by braiding, automated fibre placement (AFP) or prepreg wrap techniques. However, in preferred examples, applying the outer reinforcement (and optionally the further outer reinforcement) comprises filament winding. Filament winding techniques are particularly well-suited for making composite structural components from carbon-fibre reinforced polymer (CFRP).

BRIEF DESCRIPTION OF THE DRAWINGS

One or more non-limiting examples will now be described, by way of example only, and with reference to the accompanying figures, in which.

DETAILED DESCRIPTION

Figure 1:
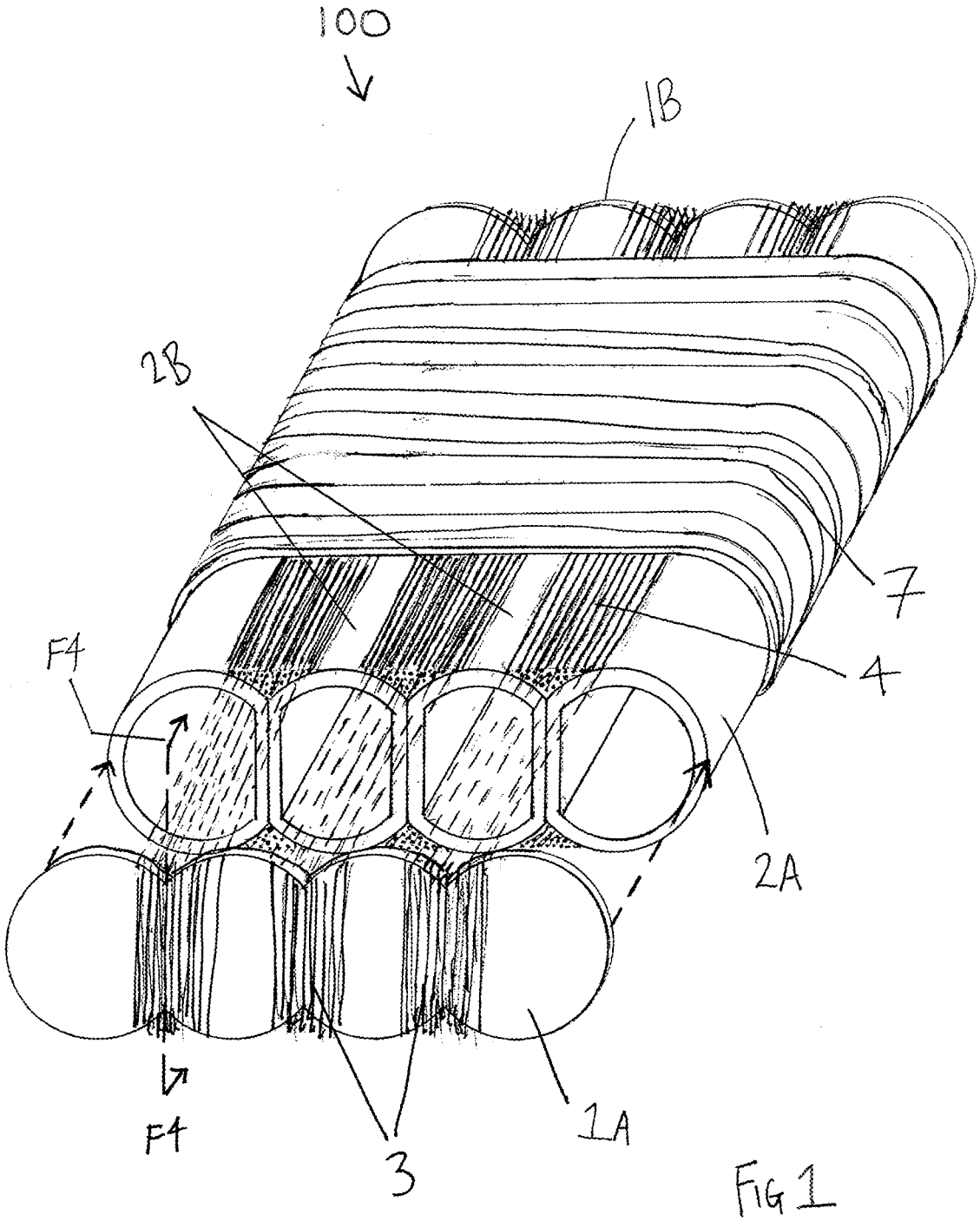
FIG. 1 shows an exploded view of a pressure vessel in accordance with an example of the present disclosure.

FIG. 1 shows an exploded view of a pressure vessel 100 in accordance with an example of the present disclosure. The pressure vessel 100 comprises: a plurality of tubular vessel structures 2A, 2B; front and rear end plates 1A, 1B; longitudinally wound fibre overwrap 3 and hoop wound fibre overwrap 7. The vessel structures 2A, 2B are open at either end and are arranged such that their longitudinal axes lie parallel to each other. They are manufactured from carbon fibre reinforced polymer composite with a high winding angle (e.g. >80° from the longitudinal axis), such that they have high resistance to hoop stresses.

Figure 3:
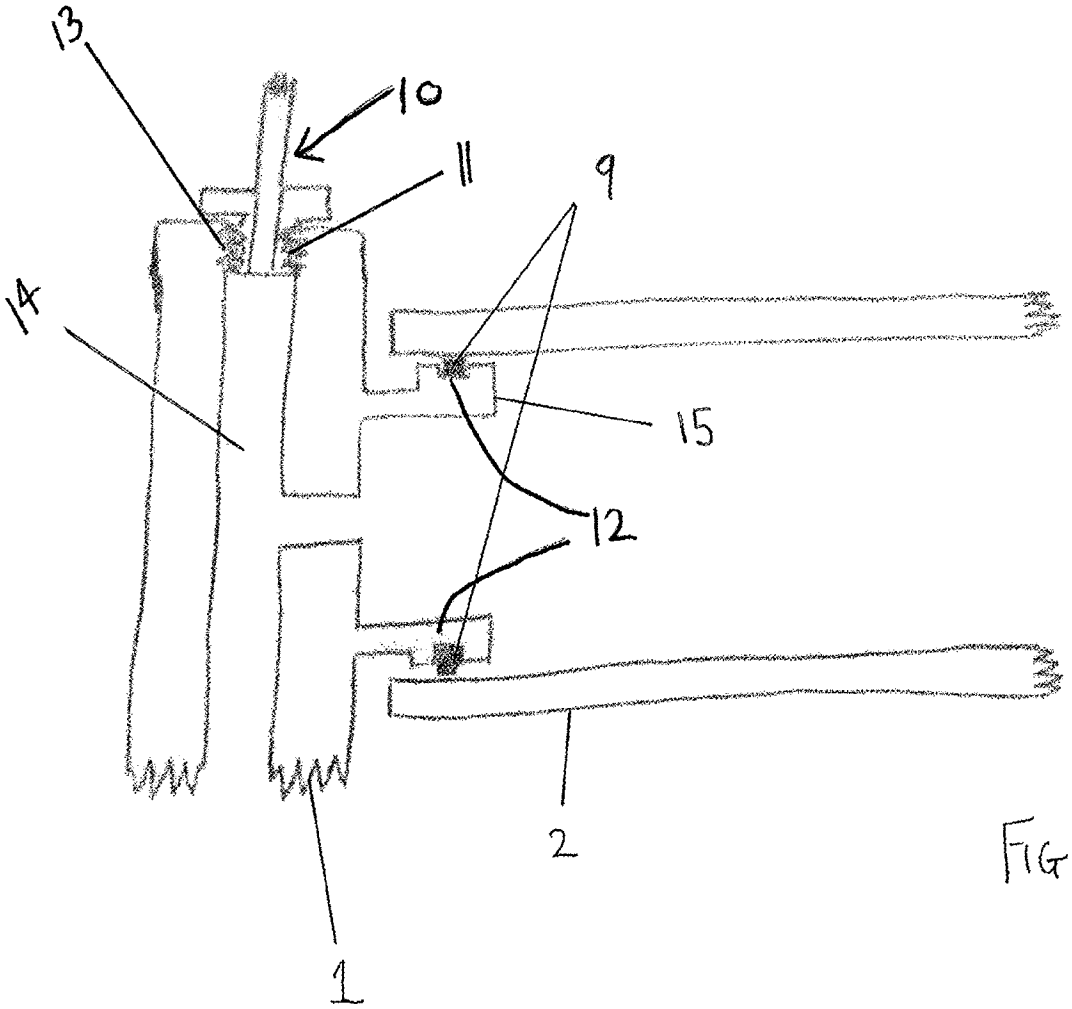
FIG. 3 shows a side cross sectional view of part of the pressure vessel.

In FIG. 1 it can be seen that the end plates 1A, 1B are positioned to close the open ends of each vessel structure 2A, 2B. In this example the end plates 1A, 1B have an outer profile that matches the cross section of the ends of the plurality of vessel structures 2A, 2B. The longitudinal fibre 3 is wound axially under tension around the pressure vessel 100 to hold the end plates 1A, 1B in contact with the ends of the tubes 2A, 2B such that the vessel structures are sealed closed. An elastomer seal may be positioned between each end plate 1A, 1B and the vessel structures (2A, 2B) to provide closure with greater pressure resistance. An example sealing arrangement is shown in FIG. 3.

The longitudinal fibre 3 is wound such that it fills the crevices 4 between the vessel structures 2A, 2B which are formed by the curvature of the walls. This prevents the longitudinal fibre 3 from slipping off the pressure vessel 100 and is more space efficient than leaving voids, or filling the crevices 4 with non-structural material that does not contribute to the strength of the pressure vessel 100. Additionally, the crevices 4 allow for greater automation of the winding process during manufacture.

Fibre 7 is also wound around the vessel in the 'hoop' (circumferential) direction under tension, providing additional hoop strength and allowing the vessel structures 2A, 2B to be constructed with thinner walls while retaining the same level of pressure resistance. This may be wound after the longitudinal fibre 3 during manufacture, such that the crevices 4 are filled and sagging of the hoop fibre reinforced layer 7 is avoided.

Figure 2:
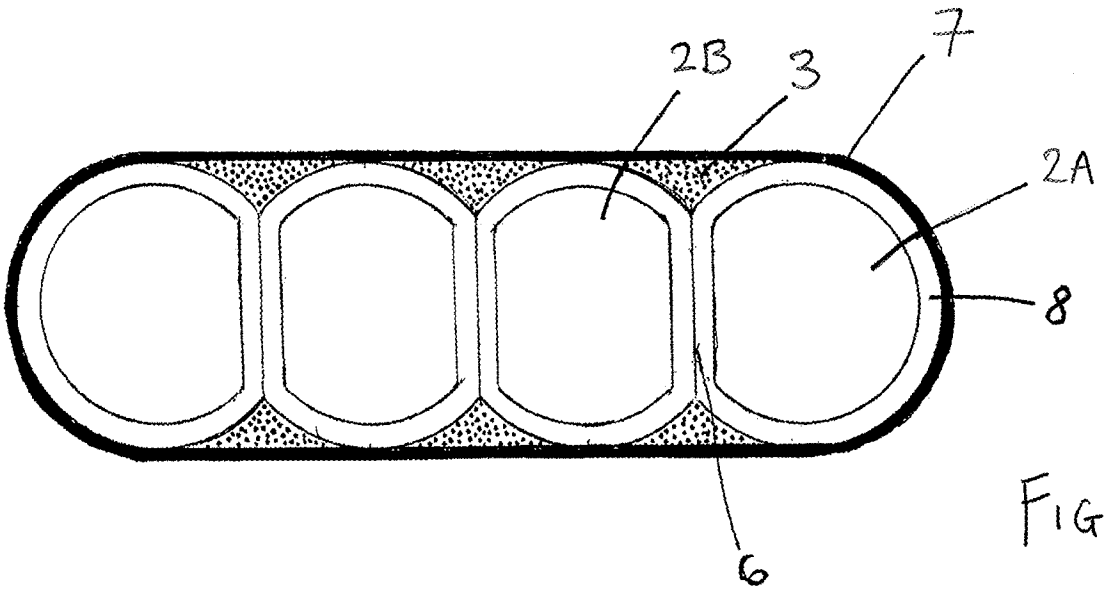
FIG. 2 shows a front cross sectional view of the pressure vessel.

As is seen in FIG. 2, the plurality of tubular vessel structures comprises exterior tubes 2A and interior tubes 2B, which have different cross sectional shapes, such that the interior tube-tube interfaces 6 are substantially flat, and the exterior tube walls 8 are curved. In use, the pressure inside each of the composite vessel structures may be substantially the same, such that the hoop stresses in the inter-vessel walls 6 are substantially reduced.

FIG. 3 shows a side cross section of an end portion of a pressure vessel where an end plate 1 closes an open-ended vessel structure 2. The end plate 1 is a manifold comprising an internal chamber 14 and a valve 10. An elastomeric seal 9, for example an O-ring, is arranged between the end plate 1 and the vessel structure 2. The end plate 1 has a flange 15 that extends axially into the interior of the vessel structure 2 to provide a circumferential surface carrying the elastomeric seal 9. The flange 15 includes a machined groove 12 that holds the O-ring seal 9. The composite vessel structure 2 therefore 'floats' on the elastomer seal 9 rather than being adhesively bonded to the end plate 1. This forms a mechanical connection between the composite vessel structures and the end plates.

The internal chamber 14 connects the interior of the vessel structure 2 to the other vessel structures (not shown) of the pressure vessel. This allows fluid to flow between the vessel structures such that they comprise one large volume. The valve 10 is fitted at one end of the channel 14 and is operable to control the ingress and exit of gas from the pressure vessel. The valve 10 comprises a threaded portion 11, and the end plate 1 has a similarly threaded portion to enable the valve to be secured to the end plate and to seal the internal chamber 14. The valve may further comprise one or more elastomeric seals (not shown) to provide a seal with a higher pressure resistance. During use the internal chamber 14 provides a fluid flow path between the vessel structures 2 and as a result the pressure inside each vessel structure may be equal.

Figure 4:
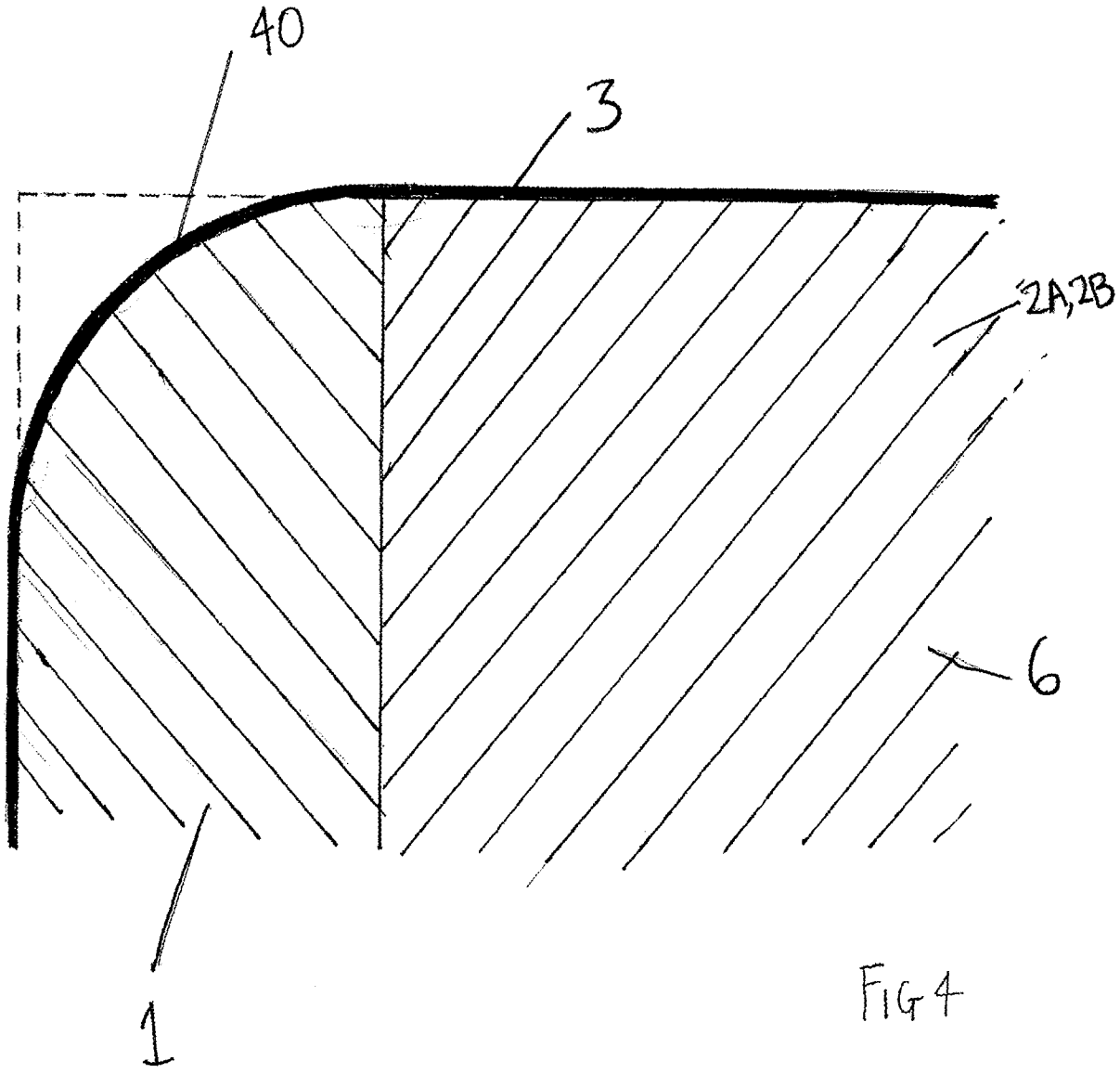
FIG. 4 is a schematic side cross sectional view of an end of the pressure vessel of FIG. 1, taken in the plane indicated by the arrows (F4) of that figure.

FIG. 4 shows schematically how the longitudinally wound fibre overwrap 3 lies along the cross-sectional profile 40 of the end plate 1 and in the crevice between vessel structures 2A, 2B. The cross-sectional profile 40 of the end plate 1 is curved and the outer edge is aligned with the outer diameter of the vessel structures 2A, 2B, such that the path followed by the fibre 3 contains no sharp angles, which could lead to wear and failure. In this example, the cross-sectional profile 40 of the end plate 1 follows a smooth curve, but it could also be chamfered, or formed of several straight sections, so long as the overall cross-sectional profile 40 contains no sharp angles, for instance angles less than 110°.

The invention claimed is:

1. A pressure vessel comprising:

front and rear end plates;

a plurality of open-ended vessel structures, each vessel structure constructed of fibre-reinforced polymer matrix composite material and having a longitudinal axis extending between its open ends, the open-ended vessel structures positioned adjacent to one another so that their longitudinal axes are parallel to a longitudinal direction extending between the front and rear end plates, and the open-ended vessel structures being closed by the front and rear end plates; and an outer reinforcement comprising polymer matrix composite material with continuous fibres extending longitudinally along the longitudinal direction and around the pressure vessel to secure the front and rear end plates to the vessel structures;

wherein at least one of the vessel structures has a partially curved cross section in a plane perpendicular to its longitudinal axis, such that one or more crevices are formed between the vessel structures, running longitudinally along the longitudinal direction between the front and rear end plates; and wherein the front and rear end plates are shaped in a plane perpendicular to the longitudinal direction such that the outer reinforcement is at least partially filling the one or more crevices between the vessel structures.

2. The pressure vessel of claim 1, wherein the outer reinforcement comprises a layer of polymer matrix composite material.

3. The pressure vessel of claim 1, wherein the outer reinforcement completely fills the one or more crevices between the vessel structures.

4. The pressure vessel of claim 1, further comprising seals arranged between the open ends of the vessel structures and the front and rear end plates.

5. The pressure vessel of claim 4, wherein the front and rear end plates comprise a plurality of flanges, each flange extending inwards along the longitudinal direction to engage with one of the open-ended vessel structures and carry one of the seals.

6. The pressure vessel of claim 1, wherein the front and rear end plates are substantially planar.

7. The pressure vessel of claim 1, wherein at least a portion of the front and rear end plates in contact with the outer reinforcement has a cross sectional profile, in a plane parallel to the longitudinal axes of the vessel structures, that is substantially curved.

8. The pressure vessel of claim 1, wherein at least one of the front and rear end plates comprises a fluid flow path between at least one of the vessel structures and another one or more of the vessel structures.

9. The pressure vessel of claim 1, wherein at least some of the vessel structures comprise at least one flat wall in a plane perpendicular to their longitudinal axes and are oriented so as to have a flat wall in contact with another flat wall of an adjacent vessel structure.

10. The pressure vessel of claim 1, wherein at least some of the vessel structures comprise a lozenge shape in a plane perpendicular to their longitudinal axes, the lozenge shape comprising first and second parallel flat walls and curved walls connecting the first and second parallel flat walls.

11. The pressure vessel of claim 10, wherein the vessel structures are arranged side-by-side in contact with one another in the pressure vessel such that the curved walls form the crevices between the vessel structures which run longitudinally between the front and rear end plates.

12. A pressure vessel according to claim 1, comprising a further reinforcement comprising polymer matrix composite material with continuous fibres extending circumferentially around the pressure vessel.

13. A pressure vessel according to claim 1, wherein each of the vessel structures is constructed of fibre-reinforced polymer in which the fibres are oriented substantially perpendicular to the longitudinal axes of the vessel structures.

14. A method of manufacturing a pressure vessel, the method comprising:

positioning a plurality of open-ended vessel structures, each constructed of fibre-reinforced polymer matrix composite material and having a longitudinal axis extending between its open ends, to be adjacent to one another so that their longitudinal axes are parallel;

closing the open-ended vessel structures with front and rear end plates;

wherein at least one of the vessel structures has a partially curved cross section in a plane perpendicular to its longitudinal axis such that one or more crevices are formed between the vessel structures, running longitudinally along a longitudinal direction between the front and rear end plates; and applying an outer reinforcement comprising polymer matrix composite material by winding continuous fibres to extend longitudinally along the longitudinal direction and around the pressure vessel to secure the front and rear end plates to the vessel structures, wherein the front and rear end plates are shaped in a plane perpendicular to the longitudinal direction such that the outer reinforcement his at least partially filling the one or more crevices between the vessel structures.

15. The method of claim 14, comprising:

applying a further outer reinforcement comprising polymer matrix composite material by winding continuous fibres to extend circumferentially around the pressure vessel.

* * * * *